US007938558B2

(12) United States Patent
Wilcox et al.

(10) Patent No.: US 7,938,558 B2
(45) Date of Patent: May 10, 2011

(54) SAFETY ACCOMMODATION ARRANGEMENT IN LED PACKAGE/LENS STRUCTURE

(75) Inventors: Kurt S. Wilcox, Libertyville, IL (US); Wayne P. Guillien, Franksville, WI (US)

(73) Assignee: Ruud Lighting, Inc., Racine, WI (US)

( * ) Notice: Subject to any disclaimer, the term of this patent is extended or adjusted under 35 U.S.C. 154(b) by 560 days.

(21) Appl. No.: 11/774,422

(22) Filed: Jul. 6, 2007

(65) Prior Publication Data

US 2008/0273327 A1 Nov. 6, 2008

Related U.S. Application Data

(63) Continuation-in-part of application No. 11/744,807, filed on May 4, 2007.

(51) Int. Cl.
*F21V 1/001* (2006.01)

(52) U.S. Cl. ..... 362/236; 362/612; 362/227; 362/267; 362/812; 362/613

(58) Field of Classification Search ..... 362/236, 362/612, 613, 227, 267, 800, 812; 361/760, 361/806

See application file for complete search history.

(56) References Cited

U.S. PATENT DOCUMENTS

| | | | | |
|---|---|---|---|---|
| 5,617,131 | A | 4/1997 | Murano et al. | |
| 5,890,794 | A | 4/1999 | Abtahi et al. | |
| 6,375,340 | B1 * | 4/2002 | Biebl et al. | 362/294 |
| 6,541,800 | B2 | 4/2003 | Barnett et al. | |
| 6,641,284 | B2 | 11/2003 | Stopa et al. | |
| 6,999,318 | B2 | 2/2006 | Newby | |
| 7,204,604 | B2 * | 4/2007 | Chou | 362/227 |
| 7,324,174 | B2 * | 1/2008 | Hafuka et al. | 349/61 |
| 7,434,977 | B2 * | 10/2008 | Fukasawa et al. | 362/631 |
| 7,604,365 | B2 * | 10/2009 | Chang | 362/97.1 |
| 7,607,799 | B2 * | 10/2009 | Ohkawa | 362/237 |
| 2004/0233667 | A1 * | 11/2004 | Hsu | 362/249 |
| 2007/0201225 | A1 | 8/2007 | Holder et al. | |
| 2008/0266852 | A1 * | 10/2008 | Valerio et al. | 362/240 |

OTHER PUBLICATIONS

WATT-MAN LED Lighting. Ultra-Bright WATT-MAN™ White LED Retrofit Lamp. Date: 2006.

WATT-MAN LED Lighting. LED Security Detention Fixture—Night Light Lamp. Date: 2006.

WATT-MAN LED Lighting. Amber LED Healthcare Night Light Fixture Retrofit Lamp. Date: 2006.

WATT-MAN LED Lighting. Amber LED Night Light Stick Lamp. Date: 2006.

International Search Report and Written Opinion. PCT/US2008/05857. Date: Aug. 19, 2008.

* cited by examiner

*Primary Examiner* — Jong-Suk (James) Lee
*Assistant Examiner* — Mark Tsidulko
(74) *Attorney, Agent, or Firm* — Jansson Shupe & Munger Ltd.

(57) ABSTRACT

An LED apparatus including (a) a mounting board, (b) a plurality of LED packages thereon, (c) a lens member over each LED package, and (d) a safety barrier positioned over the mounting board, the barrier having sufficient thickness for enclosure of electrical elements on the mounting board and including a plurality of openings each sized to permit light from an LED package to pass therethrough and through a light-transmission portion of the lens member over such LED package to prevent finger-contact of electrical elements on the mounting board when the light-transmission portion is not present.

23 Claims, 6 Drawing Sheets

SAFETY ACCOMMODATION ARRANGEMENT IN LED PACKAGE/LENS STRUCTURE

RELATED APPLICATION

This is a continuation-in-part of patent application Ser. No. 11/744,807, filed on May 4, 2007 and entitled "Sealing and Thermal Accommodation Arrangement in LED Package/Secondary Lens Structure."

FIELD OF THE INVENTION

The invention relates generally to the field of LED lighting systems and, more particularly, relates to configurations for LED modules in lighting fixtures.

BACKGROUND OF THE INVENTION

In the field of lighting, many different types of light sources have been developed. Recently, LED light sources involving multi-LED arrays, each with a large number of LED packages, have been developed as a means of bringing the many advantages of LED lighting—LED efficiency and long life—into the general illumination field. In particular, such LED light fixtures have been developed for use in outdoor settings, including by way of example lighting for parking lots, roadways, display areas and other large areas.

LED fixtures in the prior art have certain shortcomings and disadvantages. Among these, there is a need for an improved arrangement for operation of LEDs having one lens positioned over another. Significant heat levels in such products can pose particular problems for lens-over-lens mounting and stability. One potential problem is that temperature changes may cause thermal expansion and related alignment problems.

Protection against various environmental factors is also rendered difficult for LED general illumination products which necessarily utilize a large number of LEDs—sometimes plural LED modules with each module having many LED packages thereon.

The product safety of lighting fixtures creates an additional area of difficulty, and such fixtures are most often required to comply within standards put forward by organizations such as Underwriters Laboratories Inc. (UL) in order to gain acceptance in the marketplace. One such set of standards deals with the accessibility of the electrically-active parts of a fixture during operation, and, more importantly, during periods of stress on the fixture such as in a fire situation during which some elements of the lighting fixture are compromised. The UL "finger test" mandates that a human finger of certain "standard" dimensions (defined in NMX-J-324-ANCE, UL1598, Dec. 30, 2004, FIG. 19.22.1, page 231) should not be able come in contact with any electrically-live parts of the fixture under such circumstances. The standards also establish certain material limitations on the enclosures of such products, all of which are dependent on the voltages and power levels within the fixtures.

Increased product safety can be costly to achieve, both in terms of the economic cost associated with providing safety as well as with the loss of lighting performance such as reduced optical efficiency. For example, placing a fixture behind a sheet of glass to provide increased safety can result in an optical efficiency loss of up to 10%.

For LED-based lighting fixtures, the cost of the power supply is an important part of the overall fixture cost. When a large number of LEDs are used to provide the necessary level of illumination, it is advantageous to use a single power supply providing higher voltages and higher power levels, which, in turn, requires more stringent safety standards. In particular, power supplies with a Class 2 power supply rating are limited to 100 watts at a maximum of 60 volts (30 volts if under wet conditions). LED-based lighting fixtures with a large number of LEDs can benefit (both by cost and efficiency) by using a Class 1 power supply, in which both the power and voltage limitations of a Class 2 power supply are exceeded. If power requirements for a lighting fixture are higher than the Class 2 limits, then multiple Class 2 power supplies are required (which can be costly) unless the more stringent safety standards which using a Class 1 supply brings about can be achieved.

As mentioned above, such more stringent requirements include satisfying the "finger test" under certain fire conditions during which it is possible that lighting module elements such as lenses made of polymeric materials may be removed. For example, in an LED package with a primary lens made of glass and a secondary lens made of polymeric material, ti is necessary to provide enclosure barriers over the entire electrical portion of the module (on which the LED packages are mounted) except over the primary lenses. It is assumed that under these circumstances, the polymeric secondary lenses will be destroyed in the fire, leaving the primary lenses exposed. Also for example, if a single polymeric lens is used in place of both the primary and secondary lenses, then the enclosure barriers must prevent "standard finger" access to the electrical elements under the assumption the single lens has been removed.

Thus there is a need for improved LED lighting fixtures which can better serve the requirements of general-illumination lighting fixtures and which can provide both the safety and cost-effectiveness which the marketplace requires and/or prefers.

OBJECTS OF THE INVENTION

It is an object of this invention to provide LED modules which overcome certain problems and shortcomings of the prior art including those referred to above.

An object of the invention is to provide an improved LED module which achieves the electrical product safety demanded by the marketplace.

Another object of the invention is to provide an improved LED module which achieves such safety in a cost-effective manner.

Still another object of the invention is to provide an improved LED module which achieves such electrical product safety under conditions during which no lens remains place over each LED package.

These and other objects of the invention will be apparent from the following descriptions and the drawings.

SUMMARY OF THE INVENTION

The invention is LED apparatus which provides electrical safety by satisfying a set of stringent safety standards for the enclosures in which such LED apparatus are encased, and doing so in a cost-effective manner. The LED apparatus of this invention includes a mounting board having a plurality of LED packages thereon with a lens member over each LED package and a safety barrier positioned over the mounting board. The barrier has sufficient thickness for enclosure of electrical elements on the mounting board and includes a plurality of openings each sized to permit light from an LED package to pass therethrough and through a light-transmission portion of the lens member over such LED package to prevent finger-contact of electrical elements on the mounting board when the light-transmission portion is not present.

In some embodiments of the LED apparatus, the barrier includes a metal layer, which in more preferred embodiments, the barrier also includes an insulating layer positioned between the mounting board and the metal layer. In some of these embodiments, the metal layer and the insulating layer form a laminate.

In other embodiments of the inventive apparatus, the safety barrier has a layer portion spaced from the mounting board, and in some of these embodiments, the safety barrier has at least one spacing structure supporting the layer portion on the mounting board.

In preferred embodiments of the invention, the LED apparatus further includes a resilient gasket member having apertures for each of the lens members, and the gasket member yieldingly constrains movement caused by thermal expansion during operation.

In more preferred embodiments of the inventive LED apparatus, the lens members each include a light-transmission portion and a flange thereabout. The gasket member is positioned against the flanges and includes an inner surface which faces and yieldingly abuts the flanges.

In highly-preferred embodiments of the invention, the LED apparatus further includes a cover which has openings aligned with the lens members and secures them over the LED packages, pressing the gasket member toward the safety barrier.

In other highly-preferred embodiments of the inventive LED apparatus, each of the lens members is a secondary lens and each LED package includes a primary lens in alignment with the secondary lens over such LED package. In some of these embodiments, the safety barrier is positioned between the flanges of the secondary lenses and the mounting board.

Further, this invention includes an LED light fixture which has a plurality of such inventive LED modules.

The term "LED package" as used herein means an assembly including (a) a base, (b) at least one LED (sometimes referred to as "die") on the base, and (c), optionally, a primary lens over the die(s). One or more, typically several, LED packages are arranged on a mounting board in forming what is referred to as an "LED module." One or more LED modules are used as the light source for various innovative lighting fixtures.

DETAILED DESCRIPTION OF PREFERRED EMBODIMENTS

Figure 1:
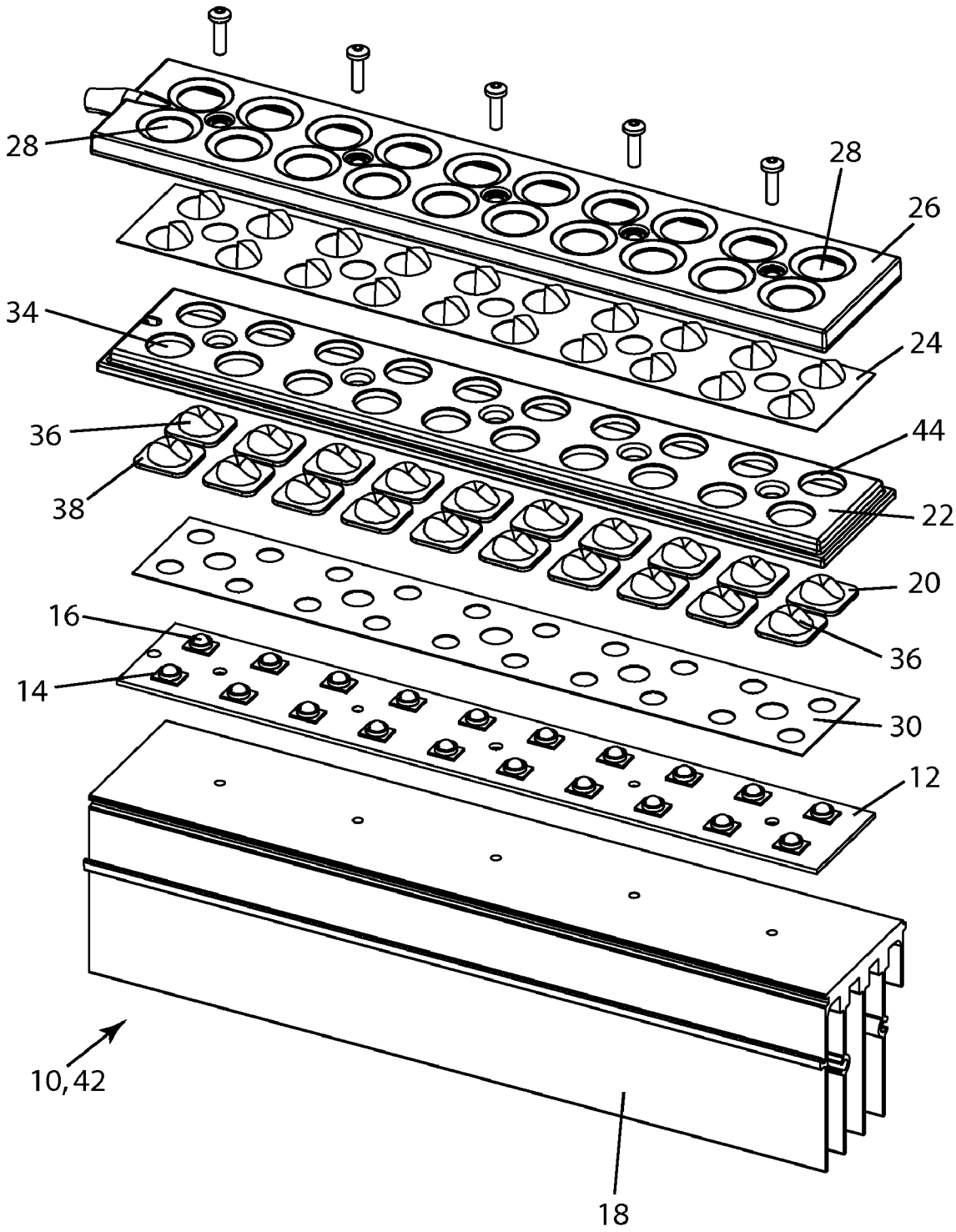
FIG. 1 is an exploded perspective view of one embodiment of the LED lighting apparatus of this invention.
Figure 2:
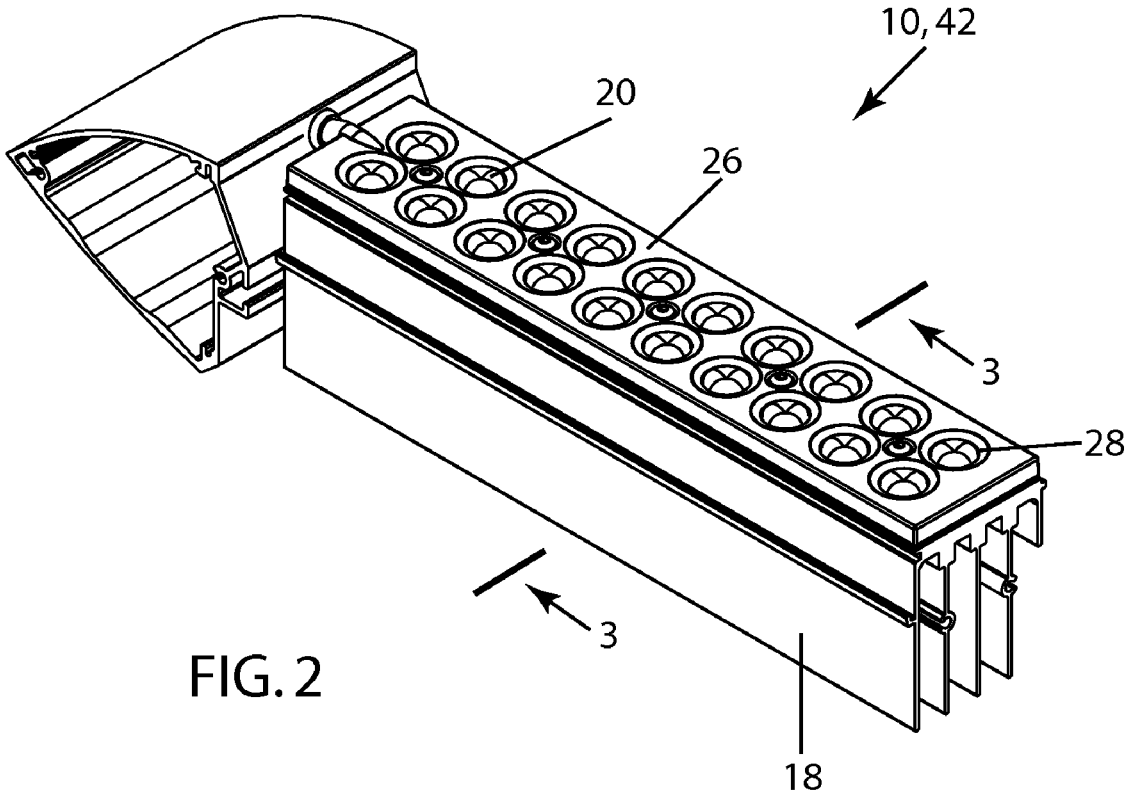
FIG. 2 is an perspective view of the inventive LED lighting apparatus of FIG. 1.
Figure 3:
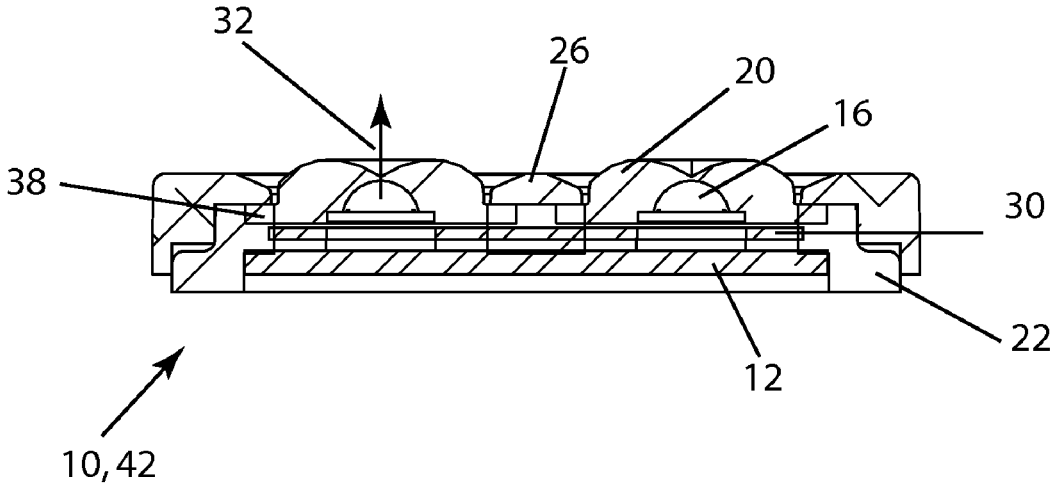
FIG. 3 is a cross-sectional view of the lighting apparatus of FIG. 1, taken along line 3-3 of FIG. 2.
Figure 12A:
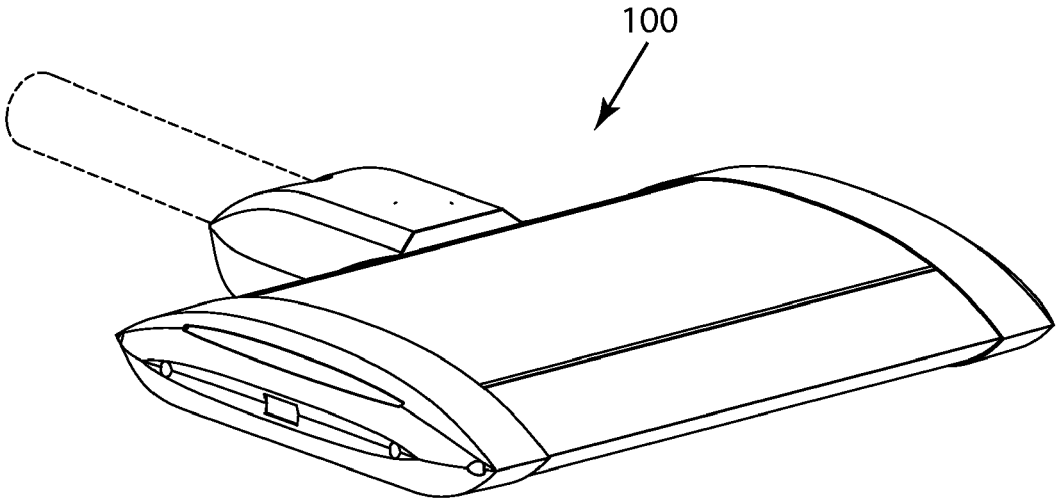
FIG. 12A is a perspective view of a lighting fixture of this invention incorporating a plurality of LED modules.
Figure 12B:
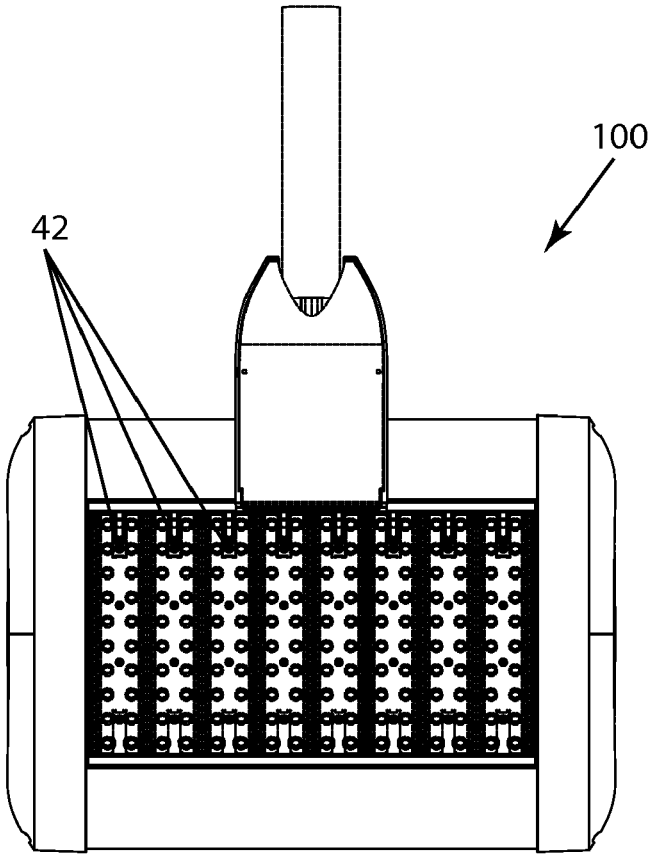
FIG. 12B is a bottom view of the lighting fixture of FIG. 12A.

FIGS. 1-3 illustrate an LED apparatus 10 which includes a mounting board 12 with a plurality of LED packages 14 thereon. The LED packages include primary lenses 16. Secondary lens 20 are positioned over primary lenses 16, establishing light paths 32 therebetween. Mounting board 12 is connected to a heat sink 18 as shown in FIG. 1. Apparatus 10, having such plural LED packages mounted thereon, is also referred to as an LED module 42 as indicate din FIG. 1. One or more LED modules 42 are used as the light source for various inventive lighting fixtures. One example of such an inventive LED lighting 100 is shown in FIGS. 12A and 12B. LED apparatus 10 includes a resilient member 22 against secondary lenses 20 in positions other than in light path 32. Resilient member 22 is yieldingly constrains secondary lenses 20 and accommodates the movement of secondary lenses 20 caused by thermal expansion during operation, primarily by that of primary lenses 16 in the embodiment shown in FIG. 1.

As shown in FIG. 1, resilient member 22, in the form of a gasket layer, is positioned over mounting board 12 and LED packages 14. Gasket 22 has a plurality of gasket apertures 34. Resilient member 22 is preferably made from closed-cell silicone which is soft, solid silicone material which is not porous. Resilient member 22 may also be made from any non-porous material which may be tailored for gasket use.

Secondary lens 20 includes a lens portion (or "light-transmission portion") 36 which is substantially transparent and a flange 38 portion thereabout. Lens portions 36 are adjacent to flange portions 38 as illustrated in FIG. 1. Flange portion 38 is planar and has outer and inner surfaces. Resilient member 22 includes an inner surface 44 which faces and yieldingly abuts flange 38.

Secondary lenses 20, as illustrated in FIGS. 1 and 2, are in close proximity to primary lenses 16 and at least partially abut primary lenses 16. Preferably separate and discrete secondary lenses 20 are each provided over each LED package 14 and primary lens 16 as seen in FIG. 2. However, persons skilled in the art will appreciate that plural secondary lenses 20 can be formed together as a single part.

FIGS. 1 and 2 illustrate that cover 26 secures resilient member 22 with respect to secondary lens 20, primary lens 16 and LED package 14. Cover 26 has openings 28 aligned with the light paths 32 as shown in FIGS. 1-3. Resilient member 22 is sandwiched between cover 26 and flanges 38 of secondary lenses 20, causing outer surface of the flange portion 38 to abut the facing resilient member 22 inner surface 44. This action forms a sandwich-like structure in which cover 26 urges resilient member 22 against flange portions 38 as illustrated in FIG. 2.

Thermal expansion of primary lenses 16 results in abutment of lenses and displacement of secondary lenses 20. Resilient member 22 permits the displacement while holding secondary lenses 20 in place over primary lenses 16.

In certain embodiments a shield member 24, in the form of a layer, is positioned over the resilient member layer 22 as illustrated in FIG. 1.

LED apparatus 10 includes a metal layer 30, preferably of aluminum. Layer 30 is positioned preferably immediately over the LED packages and includes a plurality of openings each sized to receive primary lens 16. Layer 30 is sandwiched between mounting board 12 and secondary lens 20 as seen in FIG. 1. Metal layer 30 is herein referred to as safety barrier 30, the details of which are described further below.

LED apparatus 10 can include only one LED package 14 on a mounting board 12 with primary lens 16, a corresponding secondary lens 20 and a resilient member layer 22 against the secondary lens 20.

Figure 4A:
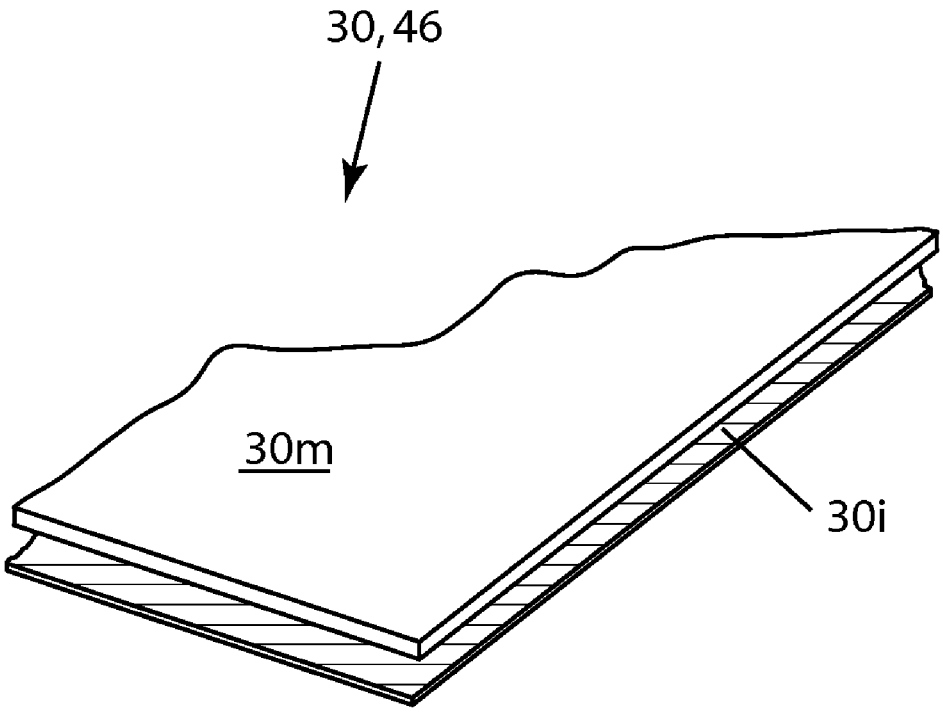
FIGS. 4A and 4B are schematic drawings illustrating a safety barrier embodied in a laminate structure.
Figure 4B:
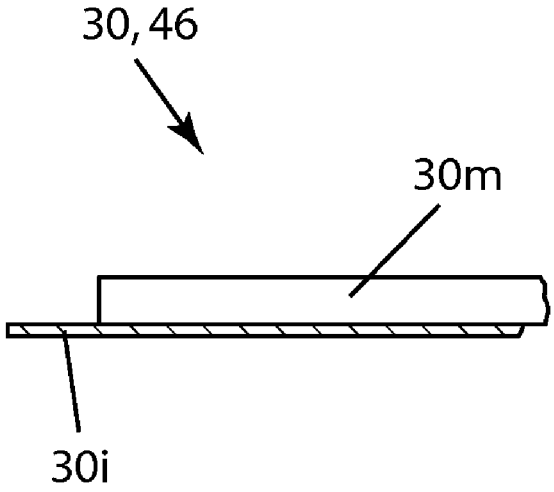

FIGS. 4A and 4B illustrate a layered structure of safety barrier 30; barrier 30 includes a metal layer 30*m* and an insulating layer 30*i*. Layers 30*m* and 30*i* may be laminated together, forming laminate 46 as indicated. Layers 30*m* and 30*i* may also be separate layers. Under certain UL standards, metal layer 30*m* is a made of a flat, unreinforced aluminum sheet having a thickness of at least 0.016 inches. The minimum thickness requirements of layer 30 depends on the structure and composition of metal layer 30 as set forth in the specific UL the standards referred to above. If safety barrier 30 is a laminate 46, the different layers of laminate 46 may or may not have the same width and length dimensions. FIGS. 4A and 4B illustrate laminate 46 with layers 30*m* and 30*i* having such different width and length.

Insulating layer 30*i* serves to electrically isolate layer 30*m* from the electrical elements on mounting board 12. In some embodiments, these electrical elements may be isolated from layer 30*m* by a conformal coating on mounting board 12. Such conformal coating may be any of a number of available coatings, such as acrylic coating 1B73 manufactured by the HumiSeal Division of Chase Specialty Coatings of Pittsburgh, Pa.

Safety barrier 30 may also be made of a single layer of polymeric material having minimum thickness as set forth by the UL standards. Acceptable polymeric materials include BASF 130FR (polyethylene terephthalate with glass fiver reinforcement) supplied by the Engineering Plastics Division of BASF Corporation in Wyandotte, Mich. The layer has a minimum thickness of 0.028 inches. Other acceptable polymeric materials must satisfy certain detailed specifications related to material behavior such as hot-wire ignition, horizontal burning, and high-current arcing resistance, all of which are set forth in the UL standards referred to above.

LED module 46 may include safety barrier 30 which is positioned in several ways relative to mounting board 12 and secondary lenses 20. When LED packages 14 do not include optional primary lens 16, secondary lenses 20 are herein referred to as "lens members 50."

Figure 5:
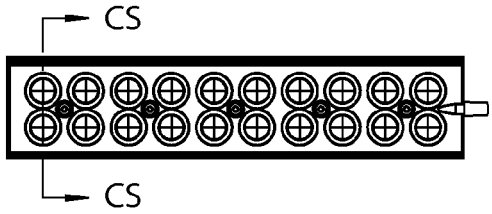
FIG. 5 is a simplified view of the inventive apparatus, illustrating the cross-sectional plane CS at which the cross-sectional views of FIGS. 6-10 are taken.

FIGS. 6-11 illustrate several such configurations of safety barrier 30 in LED module 46. FIG. 5 illustrates cross-sectional plane CS-CS which applies to each of FIGS. 6-11.

Figure 6:
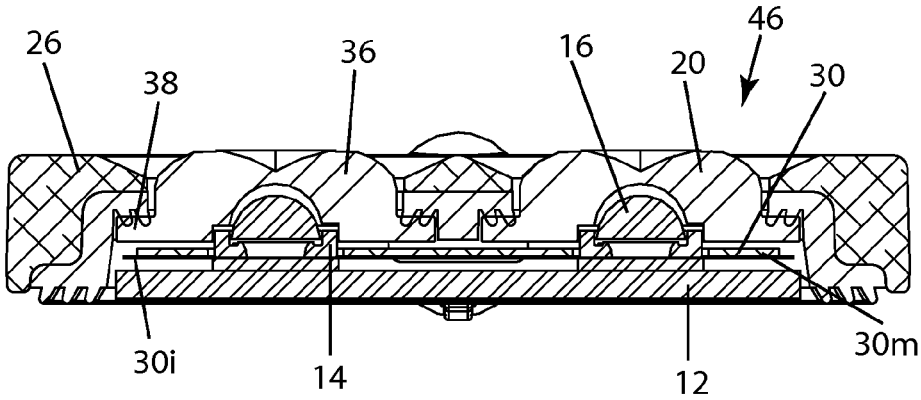
FIG. 6 is an enlarged detailed cross-sectional view of another embodiment of the LED lighting apparatus of this invention, the apparatus having a safety barrier with a metal layer and an insulating layer.

FIG. 6 is an enlarged detailed cross-sectional view of one embodiment of LED module 46 with safety barrier 30 comprising metal layer 30*m* and insulating layer 30*i*.

Figure 7:
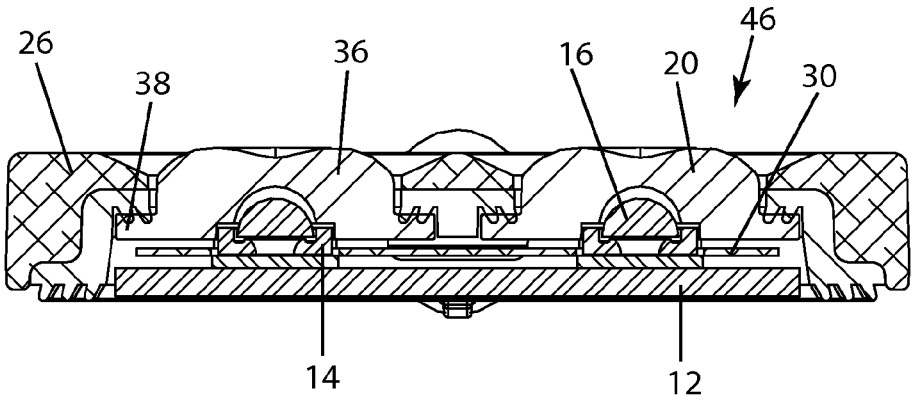
FIG. 7 is an enlarged detailed cross-sectional view of yet another embodiment of the LED lighting apparatus of this invention, the apparatus having a safety barrier comprising a single layer.

FIG. 7 is an enlarged detailed cross-sectional view of another embodiment of LED module 46 with safety barrier 30 comprising metal layer 30*m*.

Figure 8:
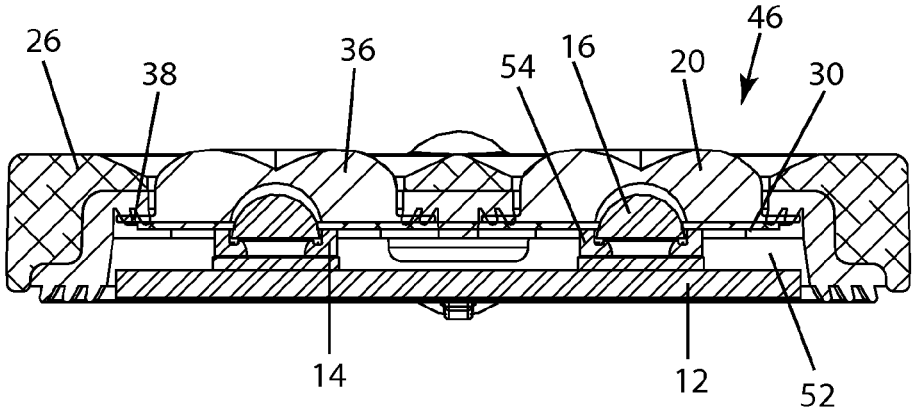
FIG. 8 is an enlarged detailed cross-sectional view of yet another embodiment of the LED lighting apparatus of this invention, the apparatus having additional space between the mounting board and the safety barrier.
Figure 9:
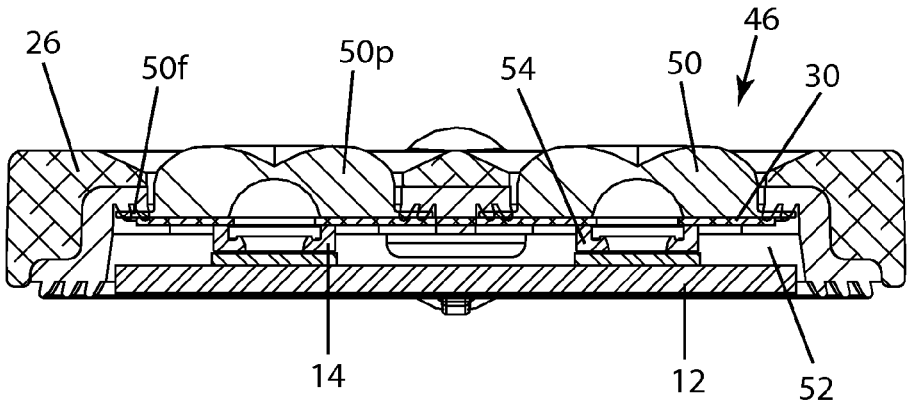
FIG. 9 is an enlarged detailed cross-section view of yet another embodiment of the LED lighting apparatus of this invention, the apparatus having a single lens member over each LED package and no optional primary lens in each LED package.

FIG. 8 is an enlarged detailed cross-sectional view of another embodiment of LED module 46 in which there is additional space 52 provided between mounting board 12 and safety barrier 30. Spacing structures 54 are provided as part of the bases of LED packages 14 but may also be configured as separate elements. FIG. 9 illustrates a similar embodiment in which LED packages 14 do not include optional primary lenses 16. LED module 46 includes lens members 50 each having light-transmission portions 50*p* and flanges 50*f*.

Figure 10:
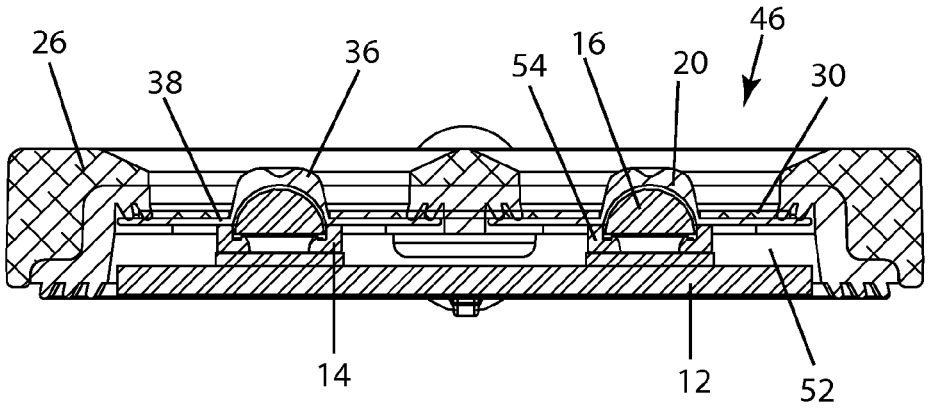
FIG. 10 is an enlarged detailed cross-sectional view of yet another embodiment of the LED lighting apparatus of this invention, the apparatus having the safety barrier positioned above the flange of each secondary lens member.
Figure 11:
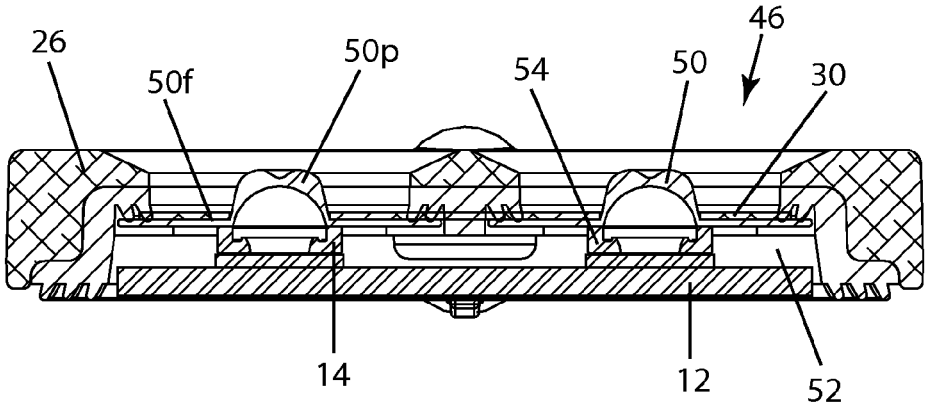
FIG. 11 is an enlarged detailed cross-sectional view of yet another embodiment of the LED lighting apparatus of this invention, the apparatus having the safety barrier positioned above the flange of each lens member, with the LED packages not including the optional primary lens.

FIGS. 6-9, LED module 46 has safety barrier 30 positioned below secondary lenses 20 or lens members 50. FIGS. 10 and 11 illustrate enlarged detailed cross-sectional view of additional embodiments of LED module 46 in which safety barrier 30 is positioned above flanges 38 of each secondary lens 20 (FIG. 10) and above flanges 50*f* of lens members 50 (FIG. 11). In both such embodiments, additional space 52 from mounting board 12 is provided.

FIG. 11 is an enlarged detailed cross-sectional view of yet another embodiment of the LED lighting apparatus of this invention, the apparatus having the safety barrier positioned above the flange of each lens member, with the LED packages not including the optional primary lens.

In some forms of such highly preferred embodiments with the plurality of LED packages on the mounting board, it is preferred to use a Flame Resistant 4 ("FR4") board formed by a conductor layer and an insulator layers. The conductor layer may be made of any suitable conductive material, preferably copper or aluminum. It is most highly preferred that such mounting board include, for each LED package thereon, a plurality of channels ("thermal vias") extending through the mounting board at positions beneath the package, such channels having therein conductive material and/or an opening to facilitate transfer of heat through the board. The thermal vias provide an isolated thermal path for each LED package.

In the forms of the present invention using the FR4 mounting board with thermal vias, it is most highly preferred that each LED package 14 is constructed to have its cathode terminal electrically neutral from the thermal path, thus avoiding shortage of other LED packages 14 on the board.

A wide variety of materials are available for the various parts discussed and illustrated herein. While the principles of this apparatus have been described in connection with specific embodiments, it should b understood clearly that these descriptions are made only by way of example and are not intended to limit the scope of the invention.

The invention claimed is:

1. An LED apparatus including (a) a mounting board, (b) a plurality of LED packages thereon, (c) a lens member over each LED package, (d) a safety barrier positioned over the mounting board, the barrier having sufficient thickness for enclosure of electrical elements on the mounting board and including a plurality of openings each sized to permit light from an LED package to pass therethrough and through a light-transmission portion of the lens member over such LED package to prevent finger-contact of electrical elements on the mounting board when the light-transmission portion is not present, and (e) a resilient gasket member having apertures for each of the lens members, the gasket member yieldingly constraining movement caused by thermal expansion during operation.

2. The LED apparatus of claim 1 wherein the barrier includes a metal layer.

3. The LED apparatus of claim 2 wherein the barrier further includes an insulating layer positioned between the mounting board and the metal layer.

4. The LED apparatus of claim 3 wherein the metal layer and the insulating layer form a laminate.

5. The LED apparatus of claim 1 wherein the barrier has a layer portion spaced from the mounting board.

6. The LED apparatus of claim 5 wherein the barrier has at least one spacing structure supporting the layer portion on the mounting board.

7. The LED apparatus of claim 1 wherein:

the lens members each include a light-transmission portion and a flange thereabout, the gasket member being against the flanges; and the gasket member includes an inner surface which faces and yieldingly abuts the flanges.

8. The LED apparatus of claim 1 further including a cover having openings aligned with the lens members and securing them over the LED packages, the cover pressing the gasket member toward the safety barrier.

9. The LED apparatus of claim 7 wherein each of the lens members is a secondary lens and each LED package includes a primary lens in alignment with the secondary lens over such LED package.

10. The LED apparatus of claim 9 wherein the safety barrier is positioned between the flanges of the secondary lenses and the mounting board.

11. An LED light fixture having a plurality LED modules, each including (a) a mounting board, (b) a plurality of LED packages thereon, (c) a lens member over each LED package, (d) a safety barrier positioned over the mounting board, the barrier having sufficient thickness for enclosure of electrical elements on the mounting board and including a plurality of openings each sized to permit light from an LED package to pass therethrough and through a light-transmission portion of the lens member over such LED package to prevent finger-contact of electrical elements on the mounting board when the light-transmission portion is not present, and (e) a resilient gasket member having apertures for each of the lens members, the gasket member yieldingly constraining movement caused by thermal expansion during operation.

12. The LED light fixture of claim 11 wherein the barrier of each module includes a metal layer.

13. The LED light fixture of claim 12 wherein the barrier of each module further includes an insulating layer positioned between the mounting board and the metal layer.

14. The LED light fixture of claim 13 wherein the metal layer and the insulating layer of each barrier form a laminate.

15. The LED light fixture of claim 11 wherein the barrier of each module has a layer portion spaced from the mounting board of the module.

16. The LED light fixture of claim 15 wherein the barrier of each module has at least one spacing structure supporting the layer portion on the mounting board of the module.

17. The LED light fixture of claim 11 wherein:

the lens members each include a light-transmission portion and a flange thereabout, the gasket member being against the flanges; and the gasket member includes an inner surface which faces and yieldingly abuts the flanges.

18. The LED light fixture of claim 17 wherein each module further includes a cover having openings aligned with the lens member and securing them over the LED packages, the cover pressing the gasket member toward the safety barrier.

19. The LED light fixture of claim 17 wherein each of the lens members is a secondary lens and each LED package includes a primary lens in alignment with the secondary lens over such LED package.

20. The LED light fixture of claim 19 wherein the safety barrier of each module is positioned between the flanges of the secondary lenses and the mounting board of the module.

21. The LED light fixture of claim 11 wherein a lens member can be more than one lens member.

22. The LED light fixture of claim 21 wherein the lens members over each LED package are separate and discrete lenses.

23. An LED apparatus including (a) a mounting board, (b) a plurality of LED packages thereon, (c) a lens member over each LED package, (d) a resilient gasket member having apertures for each lens members, the gasket member yieldingly constraining movement caused by thermal expansion during operation, and (e) a safety barrier positioned over the mounting board, the barrier having sufficient thickness for enclosure of electrical elements on the mounting board and including a plurality of openings each sized to permit light from an LED package to pass therethrough and through a light-transmission portion of the lens member over such LED package to prevent finger-contact of electrical elements on the mounting board when the light-transmission portion is not present.

* * * * *